US005520112A

United States Patent [19]

Schleinz et al.

[11] Patent Number: 5,520,112

[45] Date of Patent: May 28, 1996

[54] FOLDED SUBSTRATE, DUAL-SIDED PRINTING PROCESS AND SUBSTRATES PRINTED THEREBY

[75] Inventors: Robert J. Schleinz, Appleton, Wis.; Joseph S. Kucherovsky, Philadelphia, Pa.; Daniel J. Conrad, Murfreesboro, Tenn.

[73] Assignee: Kimberly-Clark Corporation, Neenah, Wis.

[21] Appl. No.: 347,982

[22] Filed: Dec. 2, 1994

[51] Int. Cl.[6] ..... B41F 5/04

[52] U.S. Cl. ..... 101/483; 101/220

[58] Field of Search ..... 101/483, 488, 101/223, 224, 226; 270/5, 6, 20.1, 21.1

[56] References Cited

U.S. PATENT DOCUMENTS

| | | | |
|---|---|---|---|
| H1376 | 11/1994 | Osborn, III et al. | 604/361 |
| 364,029 | 5/1887 | Macnab . | |
| 429,891 | 6/1890 | Crowell | 101/223 |
| 2,111,613 | 3/1938 | Bulford | 101/178 |
| 2,504,021 | 4/1950 | Heinrich | 101/130 |
| 3,518,940 | 7/1970 | Stroud et al. | 101/223 |
| 3,978,789 | 9/1976 | Fennekels et al. | 101/211 |
| 4,069,822 | 1/1978 | Buell | 128/294 |
| 4,147,580 | 4/1979 | Buell | 156/291 |
| 4,232,076 | 11/1980 | Stetson et al. | 428/158 |
| 4,340,212 | 7/1982 | Simson | 270/5 |
| 4,501,072 | 2/1985 | Jacobi, Jr. et al. | 101/488 |
| 4,824,503 | 4/1989 | Wilen | 270/20.1 |
| 4,967,660 | 11/1990 | Yamanari et al. | 101/229 |
| 5,214,442 | 5/1993 | Roller | 101/488 |
| 5,275,103 | 1/1994 | Hahne | 101/488 |

*Primary Examiner*—Eugene H. Eickholt
*Attorney, Agent, or Firm*—Douglas L. Miller

[57] ABSTRACT

A low basis weight substrate is printed by a folded substrate, dual-sided printing process. The substrate is folded to present two printing surfaces. The folded substrate is then passed through a printing station to have an ink pattern printed on one surface, and then is reversed to have a second pattern printed on the second printing surface. Any ink striking through one of the surfaces is collected by the other surface of the printed substrate.

10 Claims, 4 Drawing Sheets

FOLDED SUBSTRATE, DUAL-SIDED PRINTING PROCESS AND SUBSTRATES PRINTED THEREBY

BACKGROUND OF THE INVENTION

The present invention pertains to a process for printing substrates and substrates printed thereby, and more particularly to a folded substrate, dual-sided printing process and substrates printed thereby.

Printing of fabrics with various patterns and colors is well known. Some of these fabrics are used to make wearing apparel, window curtains, furniture coverings, luggage covers, and the like. Since these fabrics will experience the multiple rigors of heavy use, staining, washing, or the like, they are made of relatively sturdy and durable material that will not substantially wear out over an extended period of time.

Fortunately for the ink printing of these sturdy, durable fabrics, their relative thickness and/or density benefits the printing process used to print colored patterns, or the like, on the fabrics. In particular, the problem of ink strikethrough, i.e., printed ink running through the fabric, is absent, since the ink printed on these fabrics is absorbed within the very thickness of the fabric itself.

However, when it comes to printing lower basis weight, i.e., less thick and/or less dense, fabrics, significant problems begin to arise. Because low basis weight fabrics are relatively thin, and inherently include a large number of small voids, or a smaller number of larger voids, any ink or inks printed thereon will run through, i.e., strikethrough, the fabric. The problem with ink strikethrough is that the ink builds up on, for example, an impression cylinder of the printing apparatus. This ink buildup on the impression cylinder results in poor print quality on the fabric, the transfer of ink to the back of the fabric, and poor operating efficiency due to machinery down time required to remove the ink buildup.

This problem becomes even more significant in high speed printing environments, where ink buildup is accelerated and increases the number of times the machinery needs to be shut down for removal of the buildup. As shut down times increase, so do waste of material and ink that are associated with machinery start-up.

One attempt to resolve the problem of ink buildup is the use of doctor blades on an impression roll or the like. Although doctor blades remove ink buildup while machinery is operating, their use prematurely wears out the surface of the cylinder or roll supporting the fabric. This, in turn, results in increased costs due to replacing prematurely worn out equipment.

Another attempt to eliminate ink buildup is the running of an extra layer of material between the fabric and print rollers. The layer is designed to collect or absorb ink strikethrough and carry it away. This has proved to be costly since either the layer must be replaced with a new layer, or the layer must be cleaned of the ink before being rerun through the printing apparatus.

SUMMARY OF THE INVENTION

In one form of the present invention there is provided a folded substrate, dual-sided printing process including continuously moving a substrate having a printing surface and an opposed inner surface, folding the substrate so that the printing surface defines first and second printing surfaces and the inner surface defines first and second inner surfaces, moving the folded substrate to a printing station, printing a first pattern on the first printing surface, and then printing a second pattern on the second printing surface.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

In many prior art processes for printing a substrate, portions of the ink applied to the substrate can pass through the substrate and become deposited on the surface of, for example, an impression cylinder. This is termed "strikethrough" and causes ink buildup on the impression cylinder. It is this strikethrough and ink buildup that results in poor print quality on the substrate, the transfer of ink to the back surface of the substrate, and poor operating efficiency due to machinery down time required to remove the ink buildup. Moreover, ink strikethrough causes various undesirable graphic effects on the substrate, such as the smearing of colors, blurring of the pattern, misregistration, or the like. These undesirable effects are not pleasing to the consumer, and tend to cause a perception of poor product quality and performance.

Figure 1:
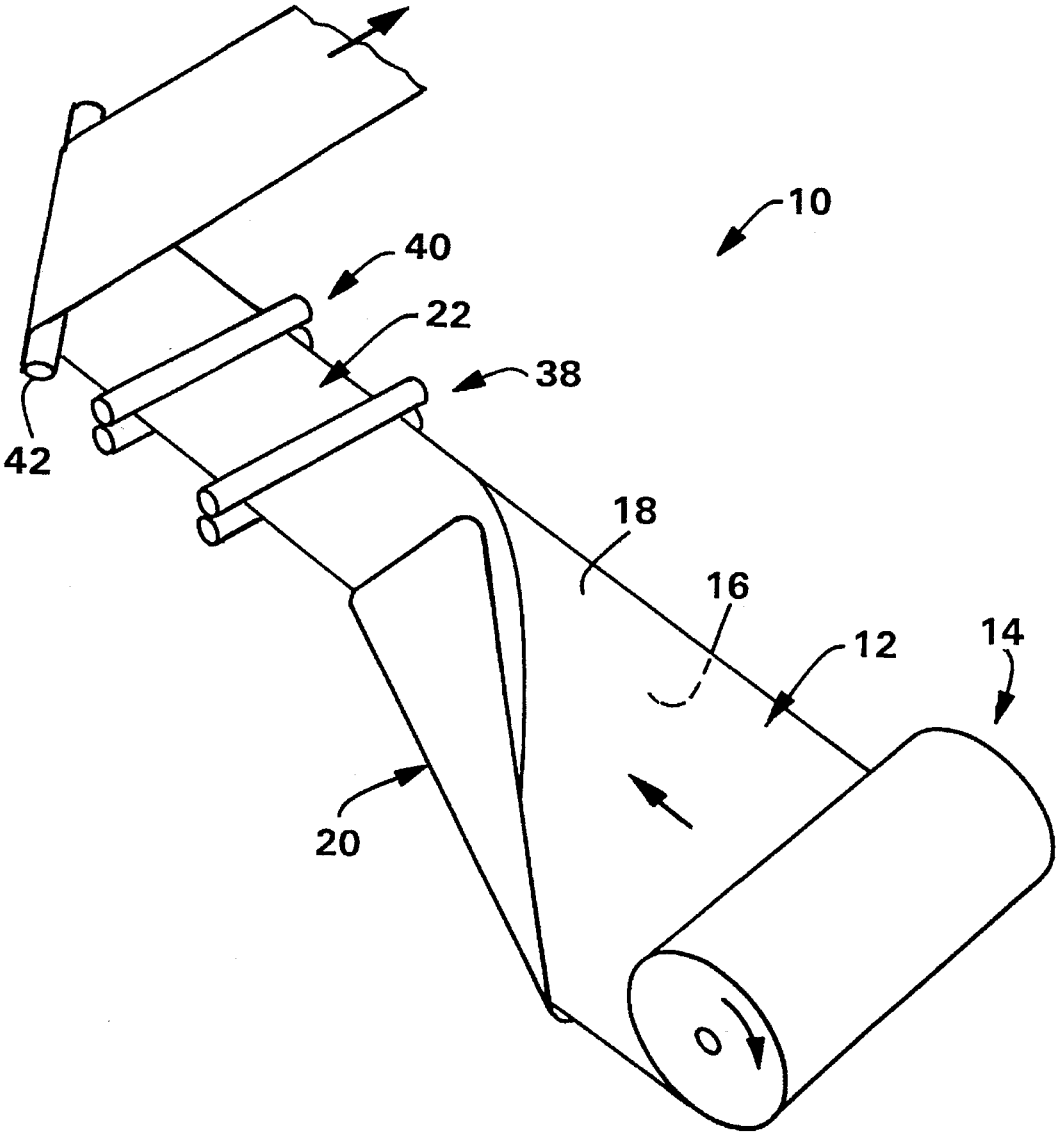
FIG. 1 illustrates the folding in half of a continuously moving substrate.
Figure 2:
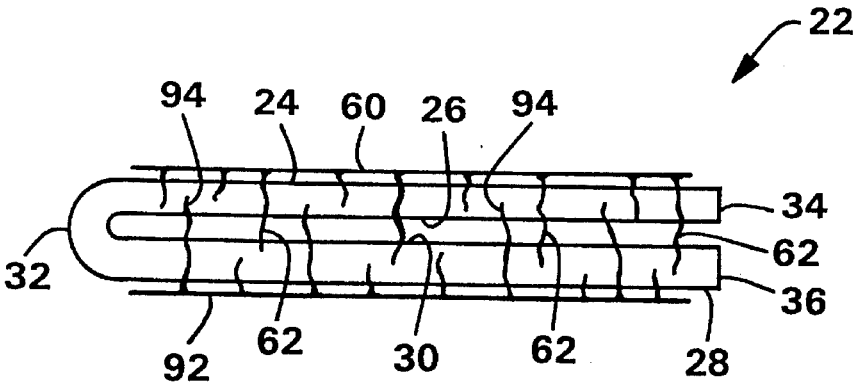
FIG. 2 illustrates a cross-sectional view of the folded substrate of FIG. 1 after it has been printed.
Figure 3:
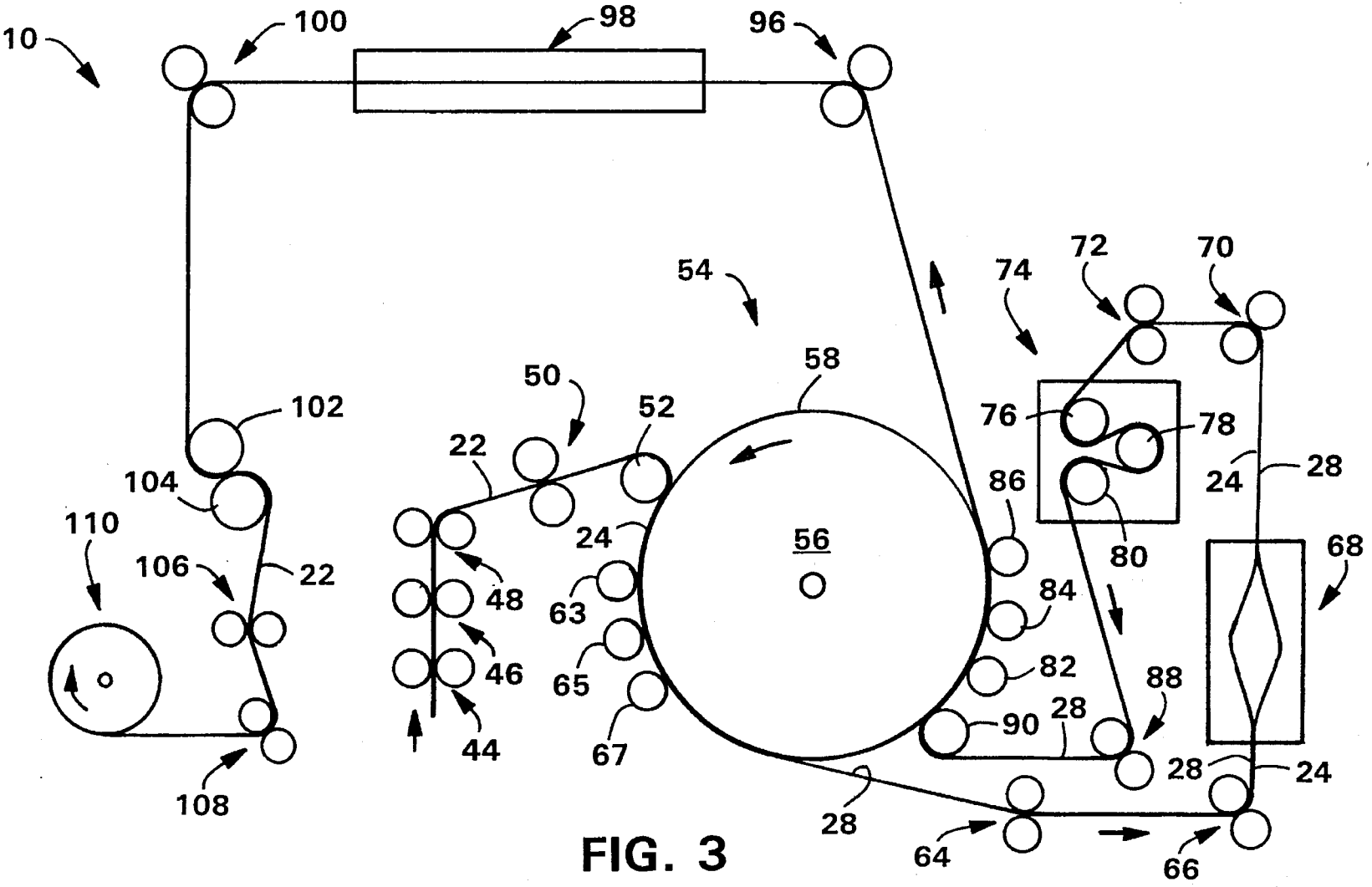
FIG. 3 illustrates schematically one apparatus operated in accordance with the principles of the present invention.

Referring to FIGS. 1–3, there is illustrated an apparatus 10 which can be operated in accordance with the principles of the present invention to print a continuously moving low basis weight substrate 12 by means of a dual-sided process that substantially eliminates ink buildup on the impression cylinder. The term "substrate" includes, but is not limited to, woven or nonwoven webs, porous films, ink permeable films, paper, or composite structures comprising a combination thereof. The term "low basis weight" refers to a substrate that has an inherent propensity for ink to strikethrough and cause ink buildup on the printing apparatus. A nonwoven substrate is considered a low basis weight substrate when its basis weight is equal to or less than about 20 grams per square meter. A nonwoven substrate having a basis weight greater than about 20 grams per square meter will be considered a high basis weight substrate.

The term "pattern", when used with reference to printing herein, includes, but is not limited to, any type of design, mark, figure, identification code, graphic, word, image, or the like.

The present invention desirably utilizes a flexographic printing process to provide the proper balance of cost effectiveness, high speed, and high quality. The printing process of the present invention is suitable for printing low basis weight substrates, such as low basis weight nonwoven webs, while maintaining the tactile softness of the substrates. Flexography is a printing technology utilizing flexible raised rubber or photopolymer plates to carry the pattern to a given substrate. The flexible plates typically carry a low viscosity ink directly onto the substrate. Examples of suitable low viscosity inks include inks comprising a non-catalytic block urethane resin and a solvent blend comprising up to about 50% by volume of acetate and up to about 75% by volume of glycol ether. The solvent blend also may comprise up to about 10% by volume of alcohol.

Suitable acetates include ethyl acetate, N-propyl acetate, N-butyl acetate, isopropyl acetate, isobutyl acetate, butyl acetate, and blends thereof.

Suitable glycol ethers include ethylene glycol monopropyl ether, ethylene glycol monobutyl ether, diethylene glycol monomethyl ether, diethylene glycol monopropyl ether, propylene glycol monomethyl ether, and blends thereof.

Suitable alcohols include ethyl alcohol, isopropyl alcohol, N-propyl alcohol, and blends thereof.

A more detailed description of inks suitable for use with the present invention is contained in U.S. patent application Ser. No. 08/171,309, filed Dec. 20, 1993, which is assigned to the assignee of the present invention, the contents of which are incorporated by reference herein.

Various flexographic printing presses can be desirably used with the present invention, and two such designs include the central impression cylinder design and the stack-style design.

The types of plates that can be used with the flexographic process include plates identified as DuPont Cyrel® HL, PQS, HOS, PLS, and LP, which may be commercially obtained from E. I. DuPont de Nemours and Company, Inc., of Wilmington, Delaware. Other suitable plates can be commercially obtained from BASF of Clifton, N.J., and from W. R. Grace and Company of Atlanta, Ga.

Although flexographic printing is desired, other printing apparatus are also contemplated by the present invention. These other printing apparatus include screen printing, rotogravure printing in which an engraved print roll is utilized, and ink jet printing in which nozzles spray ink droplets that are selectively deflected by an electrostatic charge to form the desired pattern on the substrate. It is desirable that inks used with these apparatus have a viscosity equal to or less than about 10 centipoise.

The folded substrate, dual-sided printing process of the present invention is a process that continuously prints low basis weight substrates. One feature of the present invention is that only a single substrate is utilized in the dual-sided printing process, and serves as its own "back-up" material to substantially eliminate ink buildup on the printing apparatus. Consequently, by substantially eliminating ink buildup, the present invention improves the quality of the printed pattern, and reduces the costs of manufacture.

Referring to FIG. 1, a printing apparatus 10 provides a continuously moving, full width, i.e., not folded, substrate 12 from an unwind 14. Substrate 12 includes a printing surface 16 and an opposed inner surface 18. From unwind 14, substrate 12 is passed to a folder 20 that folds full width substrate 12 in half to form a folded substrate, such as a half-width substrate 22.

Referring to FIG. 2, folded, half-width substrate 22 comprises a first printing surface 24, first inner surface 26, second printing surface 28, and second inner surface 30. The folding of substrate 12 also provides a folded portion 32, and first lateral edge 34 and second lateral edge 36, both of which can be aligned with each other by folder 20.

Referring to FIGS. 1 and 3, after folder 20, folded, half-width substrate 22 passes through a pair of idler rollers 38 and 40 (FIG. 1) to a turning bar 42 that turns or redirects substrate 22 towards three pairs of idler rollers 44, 46, 48 (FIG. 3). From idler rollers 48, substrate 22 passes to a steering section 50 that maintains a desired lateral alignment of substrate 22 with a printing station 54, and more particularly with a rotatable central impression cylinder 56. A nip pressure roller 52 holds or maintains the substrate 22 in contact with an outer, peripheral surface 58 of rotatable central impression cylinder 56.

After nip pressure roller 52, substrate 22 is transported by central impression cylinder 56, which can be rotated in any manner well known in the art, to front print cylinders 63, 65, 67, which print a first ink pattern 60 (FIG. 2) on first printing surface 24 (FIGS. 2–3) of the substrate. As illustrated in FIG. 3, while first printing surface 24 is being printed with first ink pattern 60, a second printing surface 28 is in contact with surface 58 of central impression cylinder 56.

Referring primarily to FIG. 2, during the printing of first ink pattern 60 on first printing surface 24, some of the ink will continue to pass through a first inner surface 26 of the substrate. This ink will then contact a second inner surface 30 and be collected or absorbed therein. The ink passing through first inner surface 26 onto second inner surface 30 is designated first ink strikethrough 62. Although FIG. 2 illustrates first inner surface 26 and second inner surface 30 in a spaced-apart relationship, they are, in fact, in contact with one another. The spaced relationship illustrated in FIG. 2 is for purposes of explanation and illustration.

Although FIG. 3 illustrates three front printing cylinders 63, 65, 67, a greater or few numbers of printing cylinders can be used to print any desired pattern on first printing surface 24. After passing front printing cylinders 63, 65, 67, substrate 22 passes through idler rollers 64, 66, which guide it toward a turning station 68 that reverses substrate 22 to present a second printing surface 28 for subsequent printing. After turning station 68, substrate 22 passes through idler rollers 70 and 72, which guide substrate 22 to a compensating roller section 74. One such compensating roller section 74 can be commercially obtained from Hurletron, Inc., of Danville, Ill. The purpose of the idler rollers here, and elsewhere, is to maintain the proper speed of and tension on substrate 22, and to maintain substrate 22 on a proper path through apparatus 10.

At compensating roller section 74, a series of compensating rollers 76, 78, 80, register any strikethrough of a pattern 60 through first inner surface 26 with a subsequent pattern to be printed by back printing cylinders 82, 84, 86 on second printing surface 28. The operation and function of compensating roller sections 74 is well known in the art of printing apparatus.

From compensating roller section 74, substrate 22 continues through idler rollers 88 and then to nip pressure roller 90 that holds or maintains substrate 22 against the surface 58 of central impression cylinder 56.

Back printing cylinders 82, 84, 86 then print a second ink pattern 92 (FIG. 2) on second printing surface 28. Any ink that strikes through second inner surface 30 is collected or absorbed at first inner surface 26. This ink passing through second inner surface 30 is designated a second ink strikethrough 94 (FIG. 2).

As thus described, ink running or striking through during the printing of substrate 22 is collected or absorbed by the other folded half of the substrate. Thus, in contrast with current printing processes described above, ink buildup on surface 58 of central impression cylinder 56 is eliminated. This is important in maintaining high print quality and in minimizing costs associated with printing, as earlier described.

After passing through printing station 54, substrate 22 continues through idler rollers 96 to a tunnel 98. Within tunnel 98, substrate 22 is subjected to a temperature and air flow suitable for drying the substrate and the ink printed thereon.

Alternatively, tunnel 98 can be a radiation curing unit to be used in conjunction with radiation curable inks. Examples of radiation curing methods include ultraviolet radiation, electron beam radiation, infrared radiation, or the like.

After passing through tunnel 98, substrate 22 continues through idler rollers 100 to a pair of chill rollers 102, 104 that cool substrate 22 to reduce substrate temperature to ambient.

Thereafter, substrate 22 passes through idler rollers 106 and 108 to be rewound by a rewind 110 for subsequent transport and handling.

Depending upon the ink used to print an ink pattern, and the material of which substrate 22 is made, the ink strikethrough 62, 94 (FIG. 2) may or may not be visually discernible to the naked eye. If ink strikethrough 62, for example, would be visually discernible in second printing surface 28, compensating roller section 74 (FIG. 3) will register that ink strikethrough with a second ink pattern 92 printed by back printing cylinders 82, 84, 86 (FIG. 3). The geometry of one ink pattern, along with its color or colors, is designed to match that of the other ink pattern to be printed by the other set of printing cylinders. By thus registering these ink patterns, clarity and definition are preserved, and undesirable ghost images in unprinted areas are eliminated.

The present invention allows apparatus 10 to be operated within an optimum speed range desirably between about 500 to about 2000 feet per minute, and for an extended period of time since shutdowns caused by ink buildup are eliminated. Furthermore, the present invention permits an optimum tension range because a folded substrate is less extensible than the unfolded substrate. A desirable tension range is between about 0.08 to about 1.5 pounds per lineal inch. Although not illustrated, the tension can be controlled by electro-pneumatic dancer rollers or transducer rollers with feedback to speed control devices, as is well known in the art.

Figure 4:
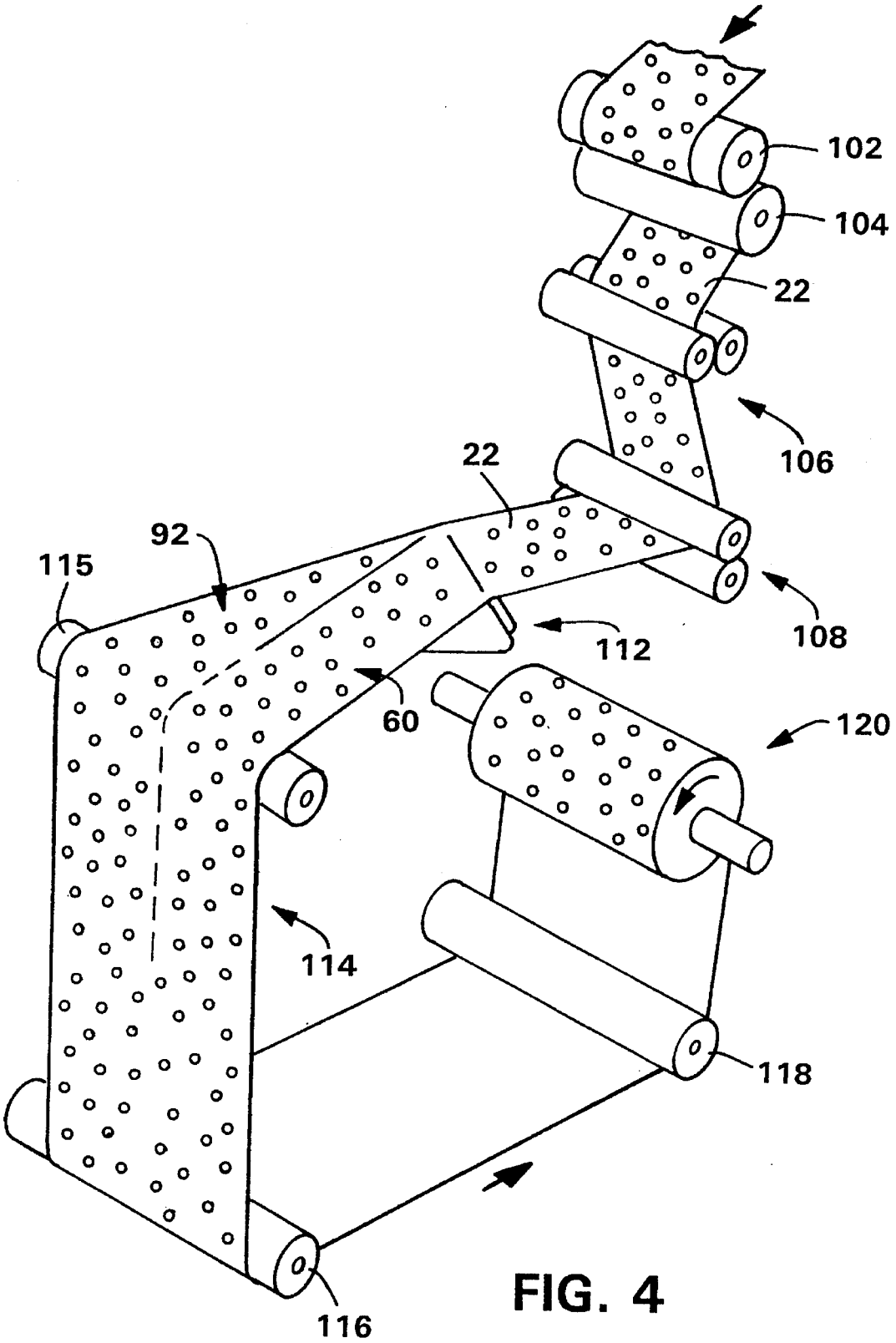
FIG. 4 illustrates an apparatus for unfolding a printed, folded substrate.

Referring now to FIG. 4, there is illustrated an alternative apparatus and method for rewinding the printed substrate 12. In FIG. 4, after substrate 22 has passed idler rollers 108, it is directed to an unfolder 112 which unfolds folded substrate 22 into an unfolded, full width printed substrate 114 having first and second ink patterns 60, 92. Thereafter, substrate 114 passes over idler rollers 115, 116, and 118 to be rewound by a full width rewind 120.

Figure 5:
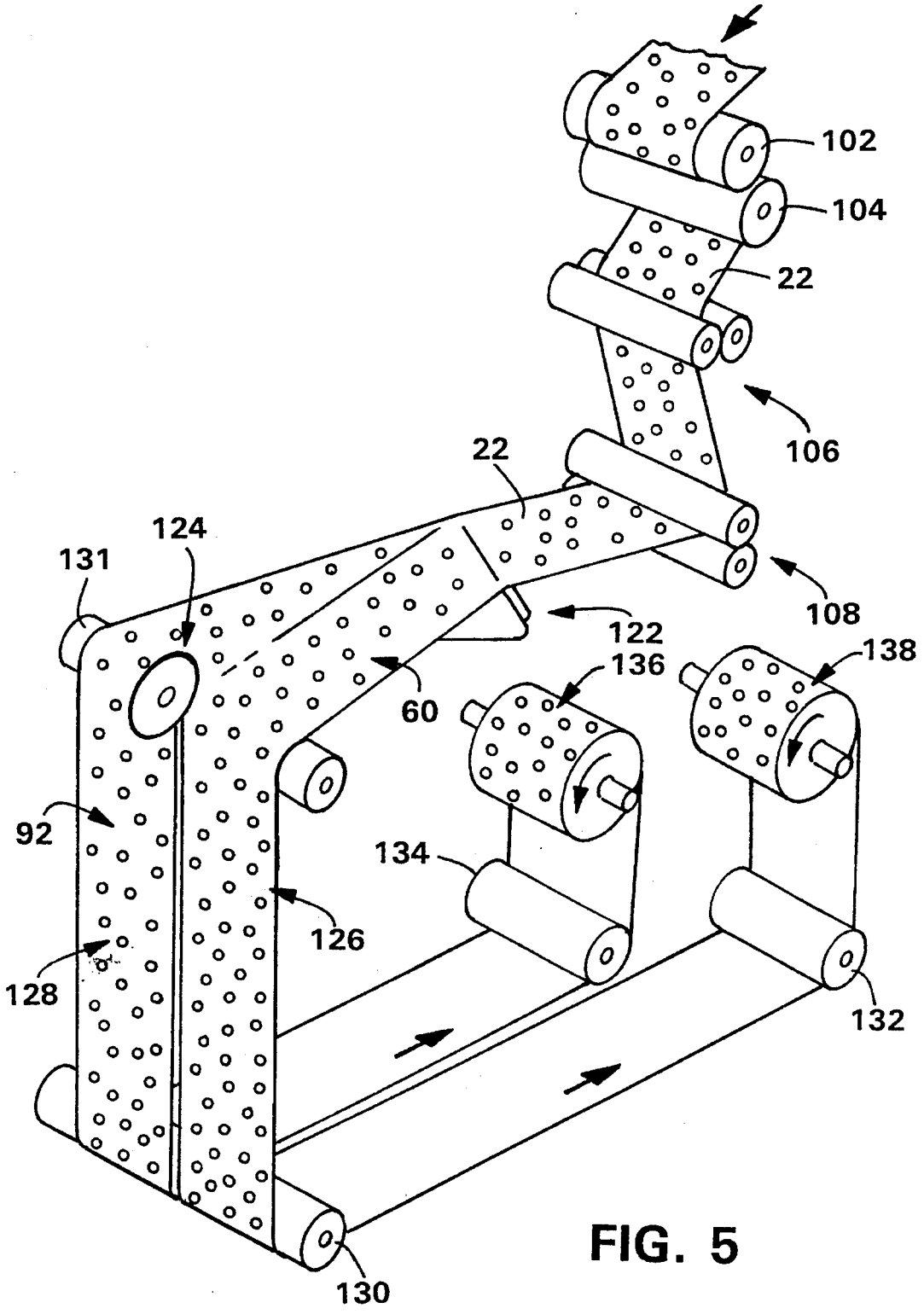
FIG. 5 illustrates an apparatus for slitting an unfolded printed substrate.

FIG. 5 illustrates another apparatus and method in which substrate 22 passes through idler rollers 108 to an unfolder 122 that unfolds substrate 22 and then to a rotating blade 124 that slits substrate 22 on a bar 131. Thereafter, a first slit substrate 126 passes over an idler roller 130 and an idler roller 132 to be rewound by a first rewind 138. Similarly, a second slit substrate 128 passes over idler roller 130 and idler roller 134 to be rewound by a secondary rewind 136.

As described earlier, the substrate can be a woven or nonwoven web or fabric, and desirably can be a polyolefin-based web. Polyolefin-based webs include, but are not limited to, woven materials, nonwoven materials, knits and porous films which employ polyolefin-based polymers. Examples of such polyolefins are polypropylene and polyethylene, including low density, high density, and linear low density polyethylene. It should be appreciated, however, that the present invention is not limited to these types of polyolefins, but embraces all types of polymers, copolymers, and natural fibers. In woven material applications, these materials can be made into continuous fibers, which are in turn woven into a fabric. In nonwoven applications, the fibers may be long, generally continuous fibers, such as spunbond fibers, or they may be shorter staple length fibers, such as are commonly used in carded webs. The fibers may also be meltblown to form the desired web. Such polymers or copolymers also may be extruded, cast, or blown into films. Other nonwovens suitable for use with the present invention include airlaid, wet laid, solution spun fiber webs, or the like.

Fibers used in accordance with the present invention can be "straight" fibers in that they have the same general polymer or copolymer composition throughout. The fibers may also be multipolymer or multicomponent fibers, such as bicomponent fibers in which at least one component is a polyolefin, such as a polyolefin sheath and a polypropylene core fiber, or a polyethylene sheath and a polyester core fiber. In addition to sheath/core fiber configurations, other examples of suitable fiber cross-sections are side-by-side, sea-in-islands, and eccentric fiber configurations. Furthermore, fibers with non-circular cross-sections such as "Y" and "X" shapes may be used.

The fibers and/or webs may have other components and/or treatments. For example, adhesives, waxes, flow modifiers, processing aids, and other additives may be used during the formation of the fibers or webs. In addition, pigments may be added to the fibers to change their color and other additives may be incorporated into the compositions to make the fibers or webs elastic. Lastly, blends of fibers, as well as straight and bicomponent fibers, may be combined to form nonwoven or woven webs suitable for use with the present invention.

The printed substrate can be used by itself, or in a multilayer configuration such as a laminate of one or more film and/or woven and/or nonwoven layers. Examples of such multilayer configurations include film/nonwoven laminates, or nonwoven/nonwoven laminates such as a spunbond/meltblown/spunbond three-layer laminate. By using such multilayer configurations, a variety of properties can be imparted to the laminate including breathability and/or liquid imperviousness.

When forming a nonwoven, such as a nonwoven polyolefin fibrous web, the fiber size and basis weight of the material can be varied according to the particular end use. In personal care products and medical fabric usage, typical fiber sizes will range from between about 0.1 to about 10 denier.

While this invention has been described as having a preferred embodiment, it will be understood that it is capable of further modification. This application is thereby intended to cover any variations, equivalents, uses, or adaptations of the invention following the general principles thereof, and including such departures from the present disclosure as come or may come within known or customary practice in the art to which this invention pertains and fall within the limits of the appended claims.

What is claimed is:

1. A folded substrate, dual-sided printing process, comprising:

continuously moving a substrate having a printing surface and an opposed inner surface, folding the substrate in half and aligning the lateral edges thereof, so that the printing surface defines a first printing surface and a second printing surface, and the inner surface defines a first inner surface and a second inner surface, moving the folded substrate to a printing station, printing a first pattern on the first printing surface at the printing station, reversing the first and second printing surfaces, printing a second pattern on the second printing surface at the printing station, and unfolding the substrate after it has been printed.

2. The process of claim 1 further comprising slitting the unfolded substrate.

3. The process of claim 1 further comprising collecting the ink strikethrough from one of the first and second printing surfaces onto the inner surface of the other of the first and second printing surfaces.

4. The process of claim 1 further comprising registering the first and second patterns.

5. The process of claim 1 further comprising drying and cooling the substrate.

6. The process of claim 1 wherein the printing is flexographic printing.

7. The process of claim 1 wherein the printing is rotogravure printing.

8. The process of claim 1 wherein the printing is ink-jet printing.

9. The process of claim 1 wherein the substrate has a basis weight equal to or less than about 20 grams per square meter.

10. The process of claim 1 further comprising radiation curing the substrate.

* * * * *